United States Patent [19]

Kurihara et al.

[11] 4,440,033

[45] Apr. 3, 1984

[54] STARTING MOTOR DEVICE

[75] Inventors: Norimitsu Kurihara, Wako; Katsuharu Kinoshita, Hanno; Masao Watanabe, Niiza; Toyohiro Sato, Nitta; Takashi Kawazoe, Kiryu, all of Japan

[73] Assignee: Honda Giken Kogyo Kabushiki Kaisha, Tokyo, Japan

[21] Appl. No.: 301,115

[22] Filed: Sep. 11, 1981

[30] Foreign Application Priority Data

| | | | |
|---|---|---|---|
| Sep. 13, 1980 | [JP] | Japan | 55-126653 |
| Mar. 7, 1981 | [JP] | Japan | 56-32918 |
| Mar. 10, 1981 | [JP] | Japan | 56-34416 |

[51] Int. Cl.[3] ..... F02N 15/06

[52] U.S. Cl. ..... 74/7 A; 74/7 R; 74/7 E

[58] Field of Search ..... 74/7 R, 7 A, 7 E; 290/38 C, DIG. 1

[56] References Cited

U.S. PATENT DOCUMENTS

| | | | |
|---|---|---|---|
| 2,354,844 | 8/1944 | Thornburg | 74/7 A X |
| 3,020,771 | 2/1962 | Redick et al. | 74/7 |
| 3,021,715 | 2/1962 | De Lorean et al. | 74/7 |
| 3,056,305 | 10/1962 | Kochendorfer | 74/7 |
| 3,171,284 | 3/1965 | Scherzinger | 74/7 |
| 3,247,727 | 4/1966 | Digby et al. | 74/7 |
| 3,616,785 | 11/1971 | Smith et al. | 123/179 F |
| 3,744,467 | 7/1973 | Wagner | 123/179 B |
| 3,771,372 | 11/1973 | Asahi | 74/7 A |
| 4,192,195 | 3/1980 | Kazino et al. | 74/7 |

*Primary Examiner*—Allan D. Herrmann
*Attorney, Agent, or Firm*—Lyon & Lyon

[57] ABSTRACT

A compact starting motor device for an engine of improved durability capable of ensuring a smooth and quick engagement of a pinion gear, operatively connected to an electric motor, with a driven gear of the engine upon actuation of an electromagnetic device without generating any substantial shock. The motor is connected through a one-way clutch to an output shaft so that a driving force is transmitted unidirectionally from the motor to the output shaft. The pinion gear is splined to a projecting end of the output shaft for relative axial movement and axially moved thereon to engage and disengage the driven gear by means of a rod which extends coaxially within the output shaft. The rod is connected through an over-load spring to the electromagnetic device having a stationary core and a movable core. A switch for energizing the electric motor is provided on the movable core. Upon actuation of the electromagnetic device, the movable core is magnetically drawn to the stationary core to axially move the pinion gear via the rod to engage the engine driven gear. At this time, if the teeth of the pinion gear are not in alignment with those of the driven gear, the movable core is further moved under magnetic attraction toward the stationary core with deformation of the over-load spring to turn on the switch to energize the electric motor whereby the pinion gear is rotated to align its teeth with those of the driven gear for complete meshing engagement therebetween.

32 Claims, 8 Drawing Figures

STARTING MOTOR DEVICE

FIELD OF THE INVENTION

This invention relates to a starting motor device in which a pinion gear is operably connected to a starting motor via a one-way clutch means so that the pinion gear drives a ring gear connected to a driven member such as, for example, an engine in order to start the engine when the starting motor is operated.

SUMMARY OF THE INVENTION

The present invention is primarily directed to provide a starting motor device which is capable of engaging a pinion gear and a driven gear such as a ring gear with each other without imparting a large impact force thereto at the start of operation and which has high durability.

It is another object of the present invention to provide a compact starting motor device which permits smooth, quick engagement and disengagement between a pinion gear and a driven gear without causing a delay in operation.

To accomplish these objects, the present invention provides a starting motor device for an engine having a driven gear, comprising, in combination: an electric motor, an output shaft mounted for rotation, one-way clutch means through which the electric motor may drive the output shaft in one direction at reduced speed, a pinion gear slidably mounted on the output shaft for axial movement but restrained from relative rotation, a rod slidably mounted coaxially within the output shaft for moving the pinion gear axially to engage and disengage the driven gear of the engine, shifting means including an electromagnetic device acting through resilient means for shifting the rod axially to engage and disengage the pinion gear with respect to the driven gear.

These and other objects, features and advantages of the present invention will be more fully undertsood from the following detailed description in conjunction with the accompanying drawings, which illustrate a few preferred embodiments of the invention.

BRIEF DESCRIPTION OF THE DRAWINGS

The accompanying drawings show embodiments of the starting motor device in accordance with the present invention wherein.

DESCRIPTION OF THE PREFERRED EMBODIMENTS

Figure 1:
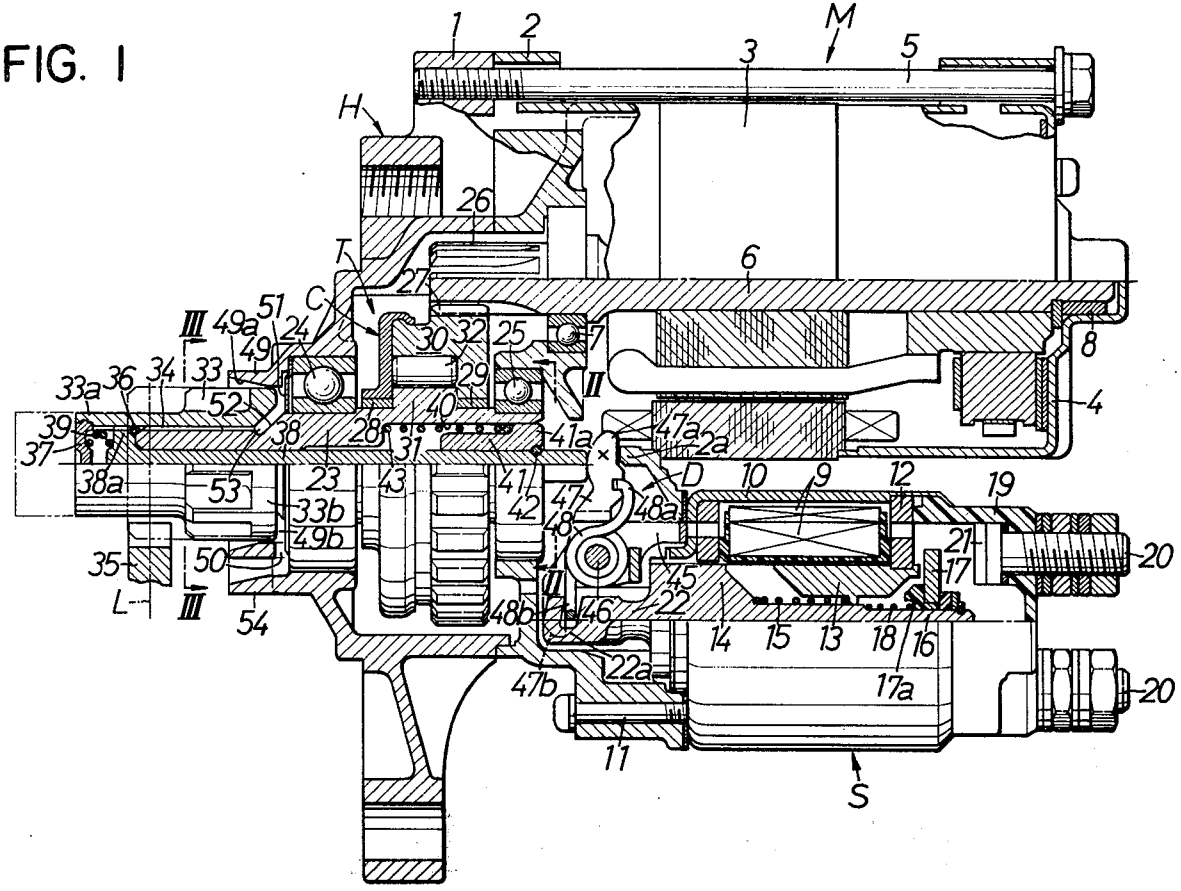
FIG. 1 is a longitudinal sectional plan view showing the major portion of a first embodiment.

Hereinafter, preferred embodiments of the present invention will be described with reference to accompanying drawings, and same references are employed to identify the same or corresponding parts of the embodiments throughout the following description and the drawings.

First, a first embodiment of the invention shown in FIGS. 1 through 5 will be described. A transmission housing represented as a whole by reference character H comprises a front housing 1 and a rear housing 2 detachably coupled to each other. A starting motor M having a stator 3 and an electromagnetic device S for actuating the motor M are fitted to the rear housing 2 parallel to each other in the following manner.

The stator 3 of the starting motor M and a rear bearing bracket 4 are sequentially superposed on the back of the rear housing 2 and fixed to the front housing 1 together with the rear housing 2 by means of bolts 5. A rotor shaft 6 of the starting motor M is rotatably supported on the rear housing 2 and on the bearing bracket 4 by a ball bearing 7 and a bearing bush 8, respectively, and the output or front end portion of the rotor shaft 6 projects into the transmission housing H.

The electromagnetic device S has a switch housing 10 for supporting a solenoid 9 secured to the rear housing 2 by a screw 11. Inside the solenoid 9 are disposed a stationary core 13, which is connected to the switch housing 10 via a yoke 12, and a movable core 14 which is retractable with respect to the front surface of the stationary core 13. Between these cores 13 and 14 is compressively disposed a return spring 15 which urges the movable core 14 away from the front surface of the stationary core 13. A switch operation rod 16 is formed integrally with the movable core 14 and extends through the stationary core 13. A moving contact 17 is slidably mounted through an insulator 17*a* on the tip of the rod 16. This moving contact 17 is normally kept at the tip of the switch operation rod 16 under the resiliency of a spring 18. A terminal cap 19 made of an insulating material is fixed to the rear end of the switch housing 10 and a pair of terminal bolts 20 are fixed to the cap 19 with its threaded end extending through an end wall of the cap 19. A pair of fixed contacts 21 facing the moving contact 17 are formed at the heads of these bolts 20. A lead wire (not shown) from a power source is connected to one of the terminal bolts 20 while a lead wire (not shown) from the starting motor M is connected to the other terminal bolt.

A projection 22 having a hook 22*a* is integrally formed with the moving core 14 and extends into the transmission housing H.

Inside the transmission housing H are disposed an output shaft 23 which extends between the rotor shaft 6 and the moving core 14 in parallel relation with each other, and a one-way clutch means T which transmits the driving force unidirectionally from the rotor shaft 6 to the output shaft 23. The output shaft 23 is rotatably supported by the front and rear housings 1 and 2 via the ball bearings 24 and 25, respectively, but cannot move in the axial direction.

The one-way clutch means T comprises a small driving gear 26 formed at the output end portion of the rotor shaft 6, a large driven gear 27 in mesh with the driving gear 26 concentrically with the output shaft 23, and a one-way clutch C interposed between the driven gear 27 and the output shaft 23. The one-way clutch C comprises an outer member 30 integrally formed with the driven gear 27 and rotatably supported on the output shaft 23 via a pair of bearing bushes 28 and 29, an inner member 31 integrally formed with the output shaft 23, and a roller 32 which is interposed between these inner and outer members 31 and 30.

A cylindrical projection 33*a* from a pinion gear 33 is splined at 34 to the output end portion of the output shaft 23, which projects beyond the front surface of the front housing 1, so as to slide back and forth in the axial direction. A ring gear 35 of the engine is inactive at a predetermined location in the advance of the pinion gear 33 so as to engage with the same upon axial movement of the pinion gear 35.

The output end of the output shaft 23 extends forward in the axial direction beyond the bisector plane L of the ring gear 35 so that when the pinion gear 33 drives the ring gear 35, the pinion gear 33 is prevented from being inclined by the driving reaction force, thereby keeping a suitable meshing engagement between both gears 33 and 35.

An opening in the hollow cylindrical projection 33*a* of the pinion gear 33 is closed by a dust preventive plate 37 caulked to the projection 33*a* so that dust or the like is prevented from entering the interior of the projection 33*a*.

The pinion gear 33 is moved by a pinion gear moving device D disposed in the transmission housing H to the position where it engages with the ring gear 35 when the electromagnetic device S is actuated.

The pinion moving device D comprises a shift rod 38 which slidably extends through the output shaft 23, a push flange 38*a* formed at the forward end of the shift rod 38 for movement between the dust preventive plate 37, a stop ring 36 anchored to the inner wall of the projection 33*a*, and a coiled spring 39 interposed between the flange 38*a* and the dust plate 37.

The rear portion of the hollow part of the output shaft 23 is enlarged to define a guide recess 40 in which is slidably fitted a cylindrical spring retainer 41 fixed on the shift rod 38 by a snap ring 42. A coiled return spring 43 is disposed in the guide recess 40 between an end wall of the recess and a flange 41*a* formed at the rear end of the cylindrical spring retainer 41 so as to urge the shift rod 38 in a retracting direction.

Figure 2:
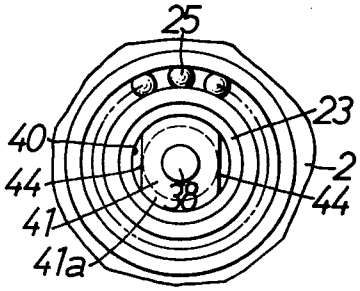
FIGS. 2 and 3 are sectional views taken along lines II—II and III—III of FIG. 1, respectively.
Figure 3:
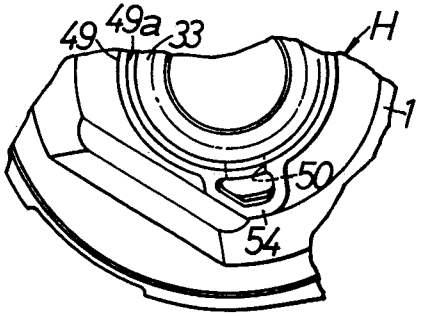
Figure 5:
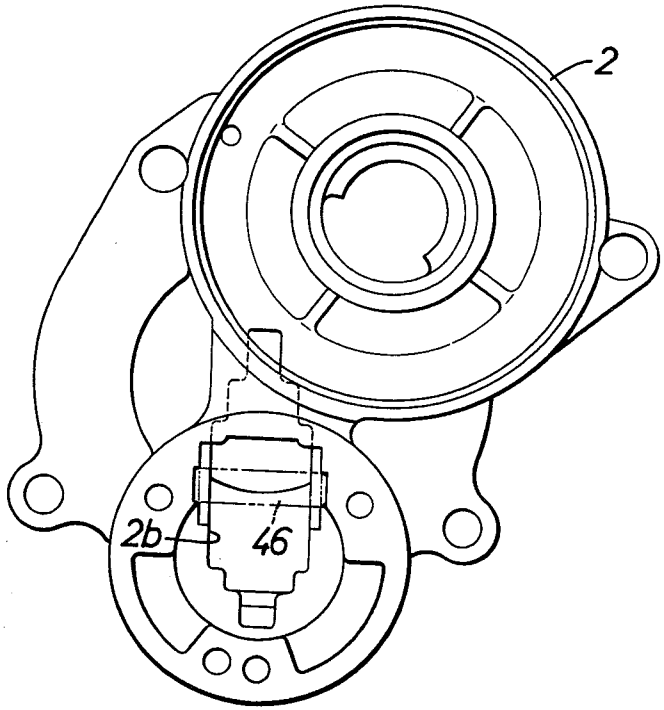
FIG. 5 is a rear view of a rear housing.

As shown in FIG. 2, a flat 44 is defined on the outer circumferential surface of the flange 41*a* of the cylindrical spring retainer 41 to form an air vent communicating the guide recess 40 with the inside of the transmission housing H, so that the cylindrical spring retainer 41 can slide in the guide recess 40 without being hindered by the air therein.

Figure 4:
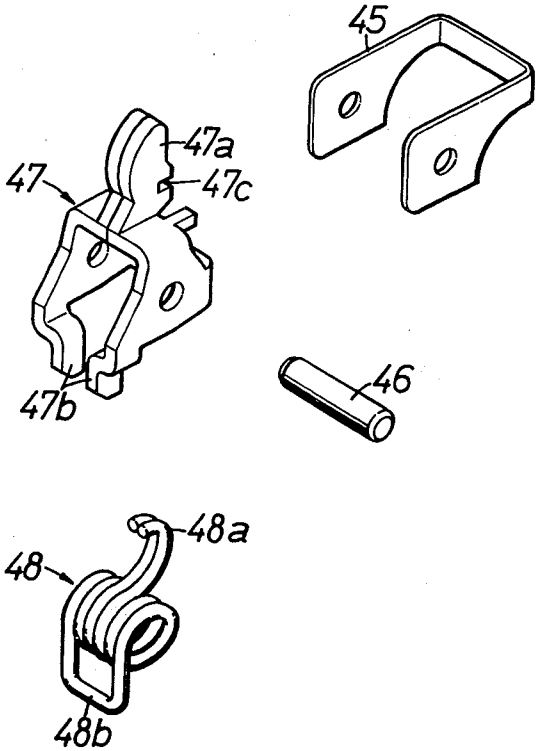
FIG. 4 is an exploded perspective view of the major portion of FIG. 1.

As shown in detail in FIG. 4, the pinion gear moving device D includes a lever holder 45 fixed to the transmission housing H, a shift lever 47 pivoted to the lever holder 45 via a pivot pin 46 and an over-load spring 48 in the form of a coiled torsion spring surrounding the pivot pin 46. The shift lever 47 has a first arm 47*a* engaging with the rear end of the shift rod 38 and a bifurcated second arm 47*b* extending in the direction opposite the first arm 47*a*, with the pivot pin 46 interposed therebetween. The over-load spring 48 has a first arm 48*a* hooked to a slot 47*c* of the first arm 47*a* of the shift lever 47, and a second arm 486 bridged between the bifurcated second arm 47*b* and held in abutment with the rear face of the second arm 47*b*. The over-load spring 48 is given a set load of a predetermined torque. The hook 22*a* of the projection 22 of the moving core 14 is anchored to the bridging portion of the second arm 48*b* of the spring 48. In this arrangement, the effective length of the second arm 48*b* of the spring 48 is shorter than that of the first arm 47*a* of the lever 47 so that the axial movement of the moving core 14 can be transmitted to the shift rod 38 at an increased rate which is changed as desired by adjusting the ratio of the effective arm lengths.

The retracting movements of the pinion gear 33, shift rod 38 and shift lever 47 caused by the expanding force of the return spring 43 are restricted by abutting engagement of the first arm 47*a* of the shift lever 47 with a stopper 2*a* defined on the inner wall of the rear housing 2.

Formed at the front end portion of the transmission housing H is a pinion gear housing 49 which accommodates the rear portion of the pinion gear 33 being retracted from the ring gear 35, and an opening 49*a* of the pinion housing 49 is outwardly diverged so as to guide entry of the pinion gear 33 into the pinion gear housing 49. Rain water, cleaning water and the like coming into the opening 49*a* are guided by the tapered surface of the opening 49*a* and discharged outside.

Disposed adjacent the bearing 24, rotatably supporting the front end portion of the output shaft 23, is a water preventive plate 51 for separating the bearing 24 from the inside of the pinion housing 49. An annular chamber 49*b* is defined in the pinion housing 49 by the water preventive plate 51 and the pinion gear 33. Inside the annular chamber 49*b* between the outer circumference of the output shaft 23 and the pinion gear 33 are formed a taper portion 52 with a progressively decreasing diameter and an annular groove 53 that continues from the smaller diameter end of the tapered portion 52. A discharge port 50 opens into the bottom or lower portion of the annular chamber 49*b* and extends therefrom in a downward direction. A shield cover 54 having a U-shaped cross-section is integrally formed on the front surface of the front housing 1 and covers an outlet of the discharge port 50. Accordingly, if by any chance water enters the inside of the pinion housing 49 or the annular chamber 49*b* from the opening 49*a*, the water therein is checked by the water preventive plate 51 from further entering the bearing 24 and thus flows down toward the annular groove 53 along the tapered portion 52 of the output shaft 23 to be discharged outside through the discharge port 50. Hence, the water is not allowed to stay inside the annular chamber 49*b*. In the embodiment shown, the bottom of the annular groove 53 is lower than that of the spline 34 of the output shaft 23 in order to prevent water from entering the spline 34 from the annular groove 53. On the other hand, water scattering towards the discharge port 50 when the car is washed or the like is prevented from entering the discharge port 50 by the shield cover 54.

An annular wall 33*b* is formed at the rear end portion of the pinion gear 33 so as to integrally connect the gear teeth of the pinion gear 33 with one another. The annular wall 33*b* acts not only to prevent water from entering the inside of the pinion housing 49 through between the gear teeth but also reinforce them.

Next, the operation of this embodiment will be described. When the start switch of the engine is operated so that a current is fed to the solenoid 9 of the electromagnetic device S, the movable core 14 is drawn to the stationary core 13 whereby the hook 22*a* of the projection 22 integral with the movable core 14 causes the shift lever 47 to rotate around the pivot pin 46 via the over-load spring 48 in the counter-clockwise direction, as viewed in FIG. 1, thereby pushing through its first arm 47*a* the rod 38 in the forward dirction (to the left in FIG. 1). By the advance of the shift rod 38, the push flange 38*a* advances the pinion gear 33 via the buffer spring 39 to a position where it engages with the ring gear 35. At this time, if the teeth of both gears 33 and 35 are not in alignment with each other so that the flanks of them abut against each other, the pinion gear 33 is stopped at this abutting position, however, the shift rod 38 advances to a position where it comes into pressure contact with the dust preventive plate 37 while compressing the buffer spring 39, and thereafter, the movable core 14 continues to move toward a position where the moving contact 17 comes into contact with the paired fixed contacts 21 against the force of the over-load spring 48, thereby actuating the starting motor M. Shock occurring upon collision of the gears 33 and 35 is absorbed by the elastic deformation of the springs 39 and 48.

In this connection, it is to be noted that a first clearance between the contacts 17 and 21, and a second clearance between the dust preventive plate 37 and the push flange 38*a*, and a third clearance between the pinion gear 33 and the ring gear 35 may be properly set such that when the second and third clearances have been taken up by the advancing movement of the shift rod 38, the movable contact 17 is brought into contact with the fixed contacts 21 without acting upon or twisting the over-load spring 48.

The rotation of the rotor shaft 6 is transmitted at reduced rate to the output shaft 23 via the driving gear 26, the driven gear 27, and the one-way clutch C, so that the output shaft 23 rotates the pinion gear 33 with a large driving torque.

As the pinion gear 33 begins to rotate to bring its teeth in alignment with those of the ring gear 35, the pinion gear 33 is advanced by the repulsive forces stored in the buffer spring 39 and the over-load torsion spring 48 so as to be placed into perfect meshing engagement with the ring gear 35 to drive the latter for engine cranking.

As the engine starts to operate, the ring gear 35 rotates at a high speed and so rotates the pinion gear 33 at a speed higher than the speed of rotation of the driven gear 27, disengaging the one-way clutch C, so that the reverse load of the ring gear 35 is not transmitted back to the starting motor M, thus preventing the motor from being overrun.

When the start switch is turned off, the movable core 14 of the electromagnetic device S is returned to its original position by the return spring 15 whereupon the moving contact 17 moves away from the fixed contacts 21 to deenergize the starting motor M. At the same time, the shift rod 38 is returned by the return spring 43 so that the pinion gear 33 is disengaged from the ring gear 35 to move into the pinion housing 49.

Figure 7:
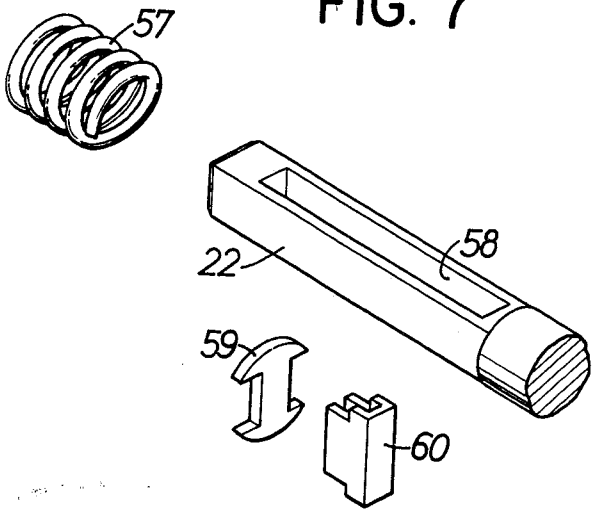
FIG. 7 is an exploded perspective view of the major portion of FIG. 6.
Figure 6:
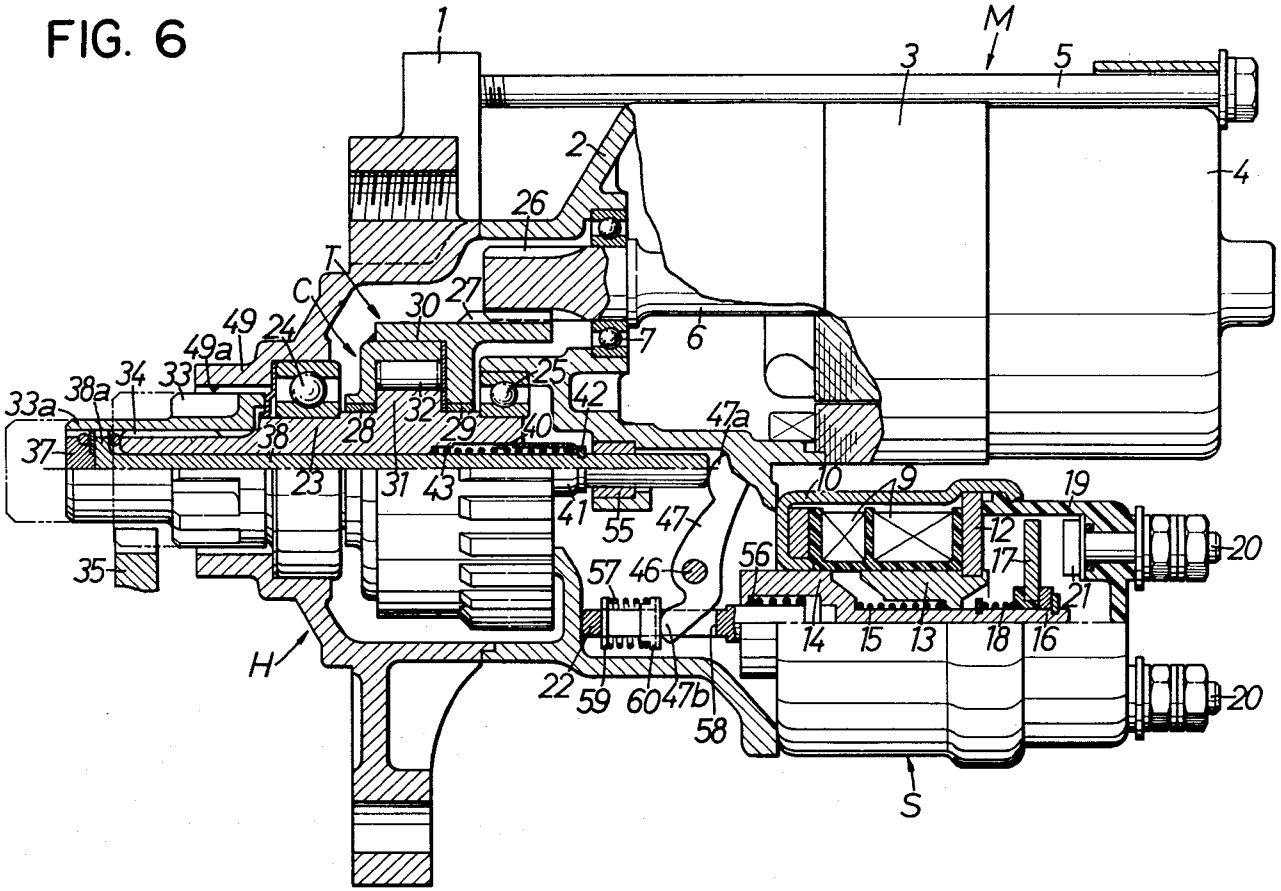
FIG. 6 is a longitudinal sectional plan view showing the major portion of a second embodiment.

FIGS. 6 and 7 show a second embodiment of the present invention and its principal difference from the first embodiment will hereinafter be described. The driven gear 27 engaging with the driving gear 26 of the rotor shaft 6 is overhung on one side surface of the outer member 30 in such a manner as to encompass the rear bearing 25 of the output shaft 23. With this construction, it is possible to minimize the amount of overhang of the driving gear 26 from the bearing 7 as well as to reduce the dead space inside the transmission housing H and hence the overall size thereof.

The shift rod 38, extending through the output shaft 23 with its one end protruded rearwardly therefrom, is slidably supported at its rearwardly protruded end by the rear housing 2 via a bush 55 so as to stabilize the sliding movement thereof.

Furthermore, the moving core 14 of the electromagnetic device S and the projection 22 are connected to each other via the first over-load coiled spring 56. An elongated opening 58 extending in the axial direction is formed in the projection 22, and a fixed seat 59 and a sliding seat 60 are disposed at the front and rear, respectively, of the elongated opening 58. A second over-load coiled spring 57 surrounding the projection 22 is interposed in a compressed state between the seats 59 and 60. The second arm 47*b* of the shift lever 47 is inserted into the elongated opening 58 and brought into contact with the back of sliding seat 60 in order to apply a predetermined set load (compressive force) to the spring 57. Therefore, when the electromagnetic device S is operated, the side surface of the pinion gear 33 abuts against that of the ring gear 35, whereby the shift rod 38 is prevented from advancing further. However, due to the compression of the first and second over-load springs 56 and 57, the movable core 14 can reliably move to a position where the contacts 17 and 21 are closed.

Figure 8:
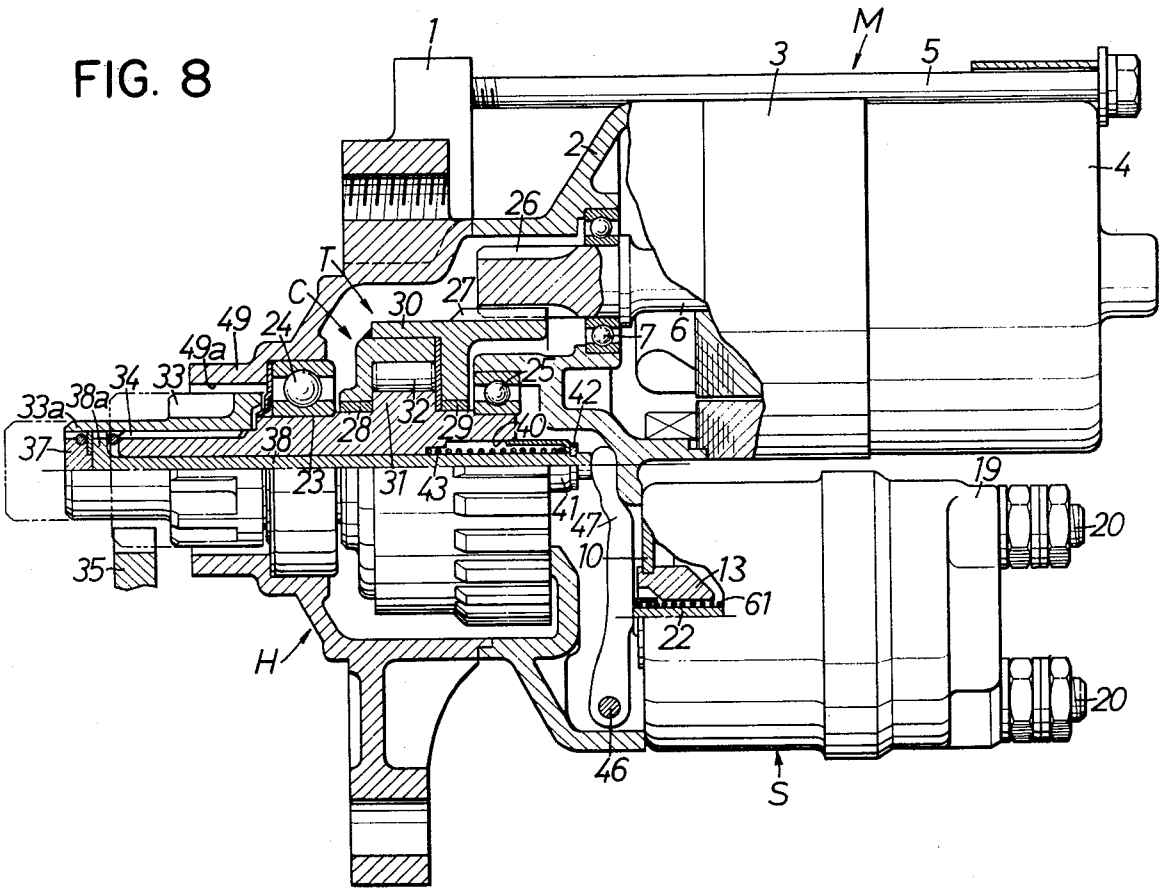
FIG. 8 is a longitudinal sectional plan view of a third embodiment.

FIG. 8 shows a third embodiment of the present invention, which is of the same construction as that of the second embodiment except that a shift lever 47 is pivoted at its base end to a transmission housing H via a pivot pin 46 with its tip end abutting against the rear end of a shift rod 38. The shift lever 47 is in abutment at its intermediate portion with a projection 22 which is connected through an over-load spring 61 to a movable core (not shown) of an electromagnetic device S so that when the electromagnetic device S is actuated to magnetically attract the movable core toward a stationary core 13, the projection 22 is moved to rotate the shift lever 47 around the pivot pin 46 to push forward the shift rod 38.

To summarize, according to the present invention, an electric motor is connected through a one-way clutch means to an output shaft so as to rotate the latter in one direction at reduced speed. A pinion gear is slidably mounted on the output shaft for axial movement but against relative rotation, and connected to a rod which is slidably mounted coaxially within the output shaft for moving the pinion gear axially to engage and disengage a driven gear or a ring gear of the engine. The rod is operatively connected to a shifting means including an electromagnetic device which acts through resilient means for shifting the rod axially to engage and disengage the pinion gear with respect to the driven gear. With this arrangement, there is obtained the following remarkable merits.

In order to start the engine, it is necessary to axially move only the rod and the pinion gear without any need of axial movement of the one-way clutch means and the output shaft so that the total mass of the axially moving members such as the rod and the like is made extremely small to minimize the force of inertia thereof to a substantial extent. As a result, the pinion gear is engageable with the driven gear in a smooth and quick manner without any delay in operation. Even if the flank of the pinion gear is brought into abutting engagement with that of the driven gear due to misalignment of their gear teeth, shock or impactive force generating upon such engagement is relatively small to improve durability of these gears because of the limited inertia of members moving together with the pinion gear.

Further, the electromagnetic device comprises a stationary core and a movable core mounting thereon a switch for energizing the electric motor so that the switch is turned on when the movable core is brought under magnetic attraction into contact with the stationary core. The rod is operatively connected to the movable core through a shift lever pivoted within a housing and an over-load spring which is given a set load. The over-load spring is deformable to allow the movement of the movable core toward the stationary core when subjected to a load exceeding the set load after the pinion gear is axially moved into abutting engagement with the engine driven gear. This ensures that the switch for the electric motor is turned on without fail in a reliable manner upon actuation of the electromagnetic device. Also, the overall axial length of the device can be reduced by optionally selecting the inclination or lever ratio of the shift lever. The shift lever and the over-load spring may be arranged adjacent to each other for further reducing the overall size of the device. The over-load spring serves to absorb shock or impactive force as generating upon engagement of the pinion gear with the driven gear, thus minimizing damage to the driven gear. Moreover, a return spring is disposed under compression in a guide recess formed in the output shaft between an end wall of the recess and a cylindrical spring retainer so as to urge the rod in a retracting direction. The cylindrical spring retainer, which is slidably fitted in the guide recess, acts as a slide journal for the rod, thus stabilizing the sliding movement thereof. The disposition of the return spring in the guide recess serves to minimize the overhanging amount of the rod, resulting in a further reduction of the length of the rod and hence the size of the entire device as well.

In addition, the inside of the guide recess is in communication with the interior of the housing through an air vent means, which is formed by flatening a side of the circumference of the cylindrical spring retainer. Due to the air vent means, the spring retainer is axially slidable in a smooth manner free from any resistance from air inside the guide recess, enabling a swift movement of the rod in response to actuation of the electromagnetic device to thereby ensure quick engagement and disengagement of the pinion gear with respect to the driven gear of the engine.

While a few proferred embodiments of the invention have been shown and described herein, it is apparent to those skilled in art that various changes and modifications may be made therein without departing from the spirit of the invention and the scope of the appended claims.

What is claimed is:

1. A starting motor device for an engine having a driven gear, comprising, in combination: an electric motor, an output shaft mounted for rotation but held against axial movement, one-way clutch means through which said electric motor may drive said output shaft in one direction, a pinion gear slidably mounted on said output shaft for axial movement but restrained from relative rotation, a rod slidably mounted coaxially within said output shaft for moving said pinion gear axially to engage and disengage said driven gear of said engine, shifting means including an electromagnetic device acting through resilient means for shifting said rod axially to engage and disengage said pinion gear with respect to said driven gear.

2. A device according to claim 1, wherein said electric motor has a rotor shaft, and said one-way clutch means comprises a driving gear secured to said rotor shaft, a driven gear rotatably mounted on said output shaft and adapted to be rotated by said driving gear at reduced speed, and a one-way clutch interposed between said driven gear and said output shaft.

3. A device according to claim 1, wherein said electromagnetic device comprises a stationary core and a movable core movable relative to said stationary core, said movable core being operatively connected with said rod so that upon actuation of said electromagnetic device, said movable core is magnetically drawn to said stationary core thereby to cause the axial movement of said rod.

4. A device according to claim 3, wherein said electromagnetic device includes a return spring disposed between said stationary and movable cores for urging said movable core away from said stationary core.

5. A device according to claim 3, wherein said shifting means includes a shift lever pivotally mounted through a pivot pin on a stationary member for operatively connecting said rod and said movable core.

6. A device according to claim 5, wherein said shift lever has an arm in abutment with said rod.

7. A device according to claim 6, including an over-load spring through which said movable core turns said shift lever, said over-load spring being given a set load and adapted to be deformable when subjected to a load exceeding said set load.

8. A device according to claim 7, wherein said over-load spring comprises a coiled torsion spring surrounding said pivot pin, said coiled torsion spring having one end abutting against said first arm of said shift lever and the other end connected to said movable core.

9. A device according to claim 5, wherein said shifting means includes a projection connected with said movable core, an over-load spring in the form of a coiled spring surrounding said projection for resilient connection between said shift lever and said projection.

10. A device according to claim 9, including a spring disposed between said projection and said movable core for resilient connection therebetween.

11. A device according to claim 5, wherein said shift lever has a base end pivoted to a stationary member, a tip end in abutment with said rod, and an intermediate portion operatively connected to said movable core.

12. A device according to claim 11, including an over-load spring disposed between said intermediate portion of said shift lever and said movable core for resilient connection therebetween, said over-load spring being given a set load and adapted to be deformable when subjected to a load exceeding said set load.

13. A device according to claim 11, including a projection abutting against said intermediate portion of said shift lever, and an over-load spring for resiliently connecting said projection with said movable core, said over-load spring being given a set load and adapted to be deformable when subjected to a load exceeding said set load.

14. A device according to claim 1, wherein a switch means is provided in a circuit connecting between said electric motor and a power source, and said resilient means comprises an over-load spring which is given a set load, said over-load spring being deformable to turn on said switch means when subjected to a load exceeding said set load after said pinion gear is brought into abutting engagement with said driven gear of said engine upon actuation of said electromagnetic device.

15. A device according to claim 1, including buffer spring disposed between said pinion gear and said rod.

16. A device according to claim 1, including a switch means in a circuit connecting between said electric motor and a power source, said switch means being turned on to supply current to said electric motor in response to actuation of said electromagnetic device.

17. A device according to claim 16, including a housing for accommodating therein said stationary and movable cores and said switch means, said switch means comprising a fixed contact secured to said housing and a movable contact mounted on said movable core in face-to-face relation with said fixed contact, said movable contact being placed into contact with said fixed contact when said movable core is magnetically drawn to said stationary core upon actuation of said electromagnetic device.

18. A device according to claim 1, wherein said pinion gear has a hollow cylindrical boss splined to said output shaft for axial movement relative thereto, said boss having an opening closed by a dust preventive cover.

19. A device according to claim 1, wherein said output shaft has one end to which is splined said pinion gear for relative axial movement, said one end extending in an axial direction beyond a bisector plane of said driven gear in meshing engagement with said pinion gear.

20. A starting motor device for an engine having a driven gear, comprising in combination: an electric motor, an output shaft mounted for rotation and held from axial movement, one-way clutch means through which said electric motor may drive said output shaft in one direction at reduced speed, a pinion gear splined to said output shaft for axial movement thereon between an operative position in which said pinion gear engages said driven gear of said engine, and a retracted position in which said pinion gear and said driven gear are disengaged, a rod slidably mounted coaxially within said output shaft for moving said pinion gear axially between said retracted position and said operative position, shifting means including an electromagnetic device for shifting said rod axially, said shifting means including resilient means for retracting said rod to disengage said pinion gear from said driven gear.

21. A starting motor device for an engine having a driven gear, comprising, in combination: a housing, an electric motor supported by said housing, an output shaft rotatably mounted in said housing through a pair of axially spaced apart bearings and being held from axial movement, means whereby said electric motor may drive said output shaft at reduced speed, said means including a one-way clutch, a pinion gear splined to a projecting end of said output shaft for axial movement thereon between an operative position in which said pinion gear engages said driven gear of said engine, and a retracted position in which said pinion gear and said driven gear are disengaged, a rod slidably mounted coaxially within said output shaft for moving said pinion gear axially between said retracted position and said operative position, a lever pivoted within said housing for shifting said rod axially to bring said pinion gear into operative position, and an electromagnetic device acting through resilient means for operating said lever.

22. A device according to claim 21, including a return spring for biasing said pinion gear to axially move on said output shaft toward said retracted position.

23. A device according to claim 22, wherein said return spring is disposed between said output shaft and said rod for moving the latter in a retracting direction.

24. A device according to claim 23, including a guide recess with an end wall formed in said output shaft, and a cylindrical spring retainer mounted on said rod and slidably fitted in said guide recess, said return spring being arranged under compression in said guide recess between said end wall and said spring retainer.

25. A device according to claim 24, including an air vent means formed through said cylindrical spring retainer for communication between said guide recess and the interior of said housing.

26. A device according to claim 25, wherein said air vent means comprises a flat defined on the outer circumferential surface of said cylindrical spring retainer.

27. A device according to claim 21, including a pinion housing integrally formed with said housing adjacent that one of said bearings which supports said projecting end of said output shaft, said pinion housing accommodating therein said pinion gear and having an opening which is diverged outwardly.

28. A device according to claim 27 including a discharge port formed through said pinion housing for communication between the inside and outside of said pinion housing.

29. A device according to claim 28, wherein said discharge port opens into said pinion housing and extends therefrom in a downward direction.

30. A device according to claim 27, including a water preventive plate disposed adjacent said one of said bearings for separating it from the inside of said pinion housing; an annular chamber defined inside said pinion housing between said plate and said pinion gear; said output shaft having a tapered portion within said annular chamber, said tapered portion converging toward said pinion gear; an annular groove formed in the circumferential surface of said output shaft at a convergent end of said tapered portion; and a discharge port opening at a lower portion of said pinion housing and extending therefrom in a downward direction.

31. A device according to claim 28, 29 or 30, including a shield cover integrally formed with said pinion housing for enclosing an outlet of said discharge port.

32. A device according to claim 31, wherein said shield cover is of a U-shaped cross section.

* * * * *